US005598979A

United States Patent [19]

Rowley, Jr.

[11] Patent Number: 5,598,979

[45] Date of Patent: Feb. 4, 1997

[54] CLOSED LOOP GRADIENT FORCE COMMINUTING AND DEHYDRATING SYSTEM

[75] Inventor: Frank F. Rowley, Jr., Valley Center, Kans.

[73] Assignee: Vortec, Inc., Valley Center, Kans.

[21] Appl. No.: 425,830

[22] Filed: Apr. 20, 1995

[51] Int. Cl.[6] ..... B02C 19/06

[52] U.S. Cl. ..... 241/5; 241/29; 241/39; 241/43

[58] Field of Search ..... 241/5, 18, 29, 241/39, 43

[56] References Cited

U.S. PATENT DOCUMENTS

| | | | |
|---|---|---|---|
| 1,830,174 | 11/1931 | Peebles . | |
| 3,800,429 | 4/1974 | Lindl | 34/79 |
| 3,937,405 | 2/1976 | Stephanoff | 241/39 |
| 4,187,615 | 2/1980 | Iwata | 34/1 |
| 4,236,321 | 12/1980 | Palmonari et al. . | |
| 4,390,131 | 6/1983 | Pickrel | 241/1 |
| 4,478,862 | 10/1984 | Greethead | 426/450 |
| 4,505,051 | 3/1985 | Herchenback et al. . | |
| 4,532,155 | 7/1985 | Golant et al. . | |
| 4,736,527 | 4/1988 | Iwamoto et al. . | |
| 4,756,093 | 7/1988 | Heinemann et al. . | |
| 5,068,979 | 12/1991 | Wireman et al. . | |
| 5,074,476 | 12/1991 | Mund | 241/17 |
| 5,096,744 | 3/1992 | Takei et al. | 241/5 X |
| 5,143,303 | 9/1992 | Niemi | 241/5 |
| 5,236,132 | 8/1993 | Rowley, Jr. | 241/5 |
| 5,346,141 | 9/1994 | Kim et al. | 241/5 |
| 5,413,285 | 5/1995 | Matthews et al. | 241/5 |
| 5,421,524 | 6/1995 | Haddow | 241/5 |

*Primary Examiner*—John M. Husar

*Attorney, Agent, or Firm*—Litman, McMahon and Brown L.L.C.

[57] ABSTRACT

An improved comminuting and dehydrating system is efficient, environmentally sound, and may be employed to process sticky materials. The system preferably includes a pair of intercoupled cyclone devices for comminuting and dehydrating, each equipped with a discharge containment unit. A blower is coupled with the primary cyclone to provide air flow, and a channel is included between the blower and the primary discharge containment unit to provide pressure equalization. An injection port is positioned remotely adjacent the discharge portion of the primary cyclone to permit injection of viscid substances such as eggs into the low pressure area of the cone. In preferred forms, the secondary cyclone device includes an exhaust filter and a meter for measuring the passage of material to be comminuted and dehydrated.

16 Claims, 4 Drawing Sheets

CLOSED LOOP GRADIENT FORCE COMMINUTING AND DEHYDRATING SYSTEM

BACKGROUND OF THE INVENTION

1. Field of the Invention

The present invention is broadly concerned with an improved closed loop comminuting and dehydrating system which provides numerous advantages, including expanded application to viscid materials, increased efficiency, enlarged capacity, and emissions control. More particularly, it is concerned with a comminuting and dehydrating system having a cyclonic comminuter unit, a blower, a collection chamber, and a valve-controlled conduit intercoupling the blower and closed collection chamber for equalizing pressure in the chamber. An injection port permits introduction of materials directly into the low pressure zone of the cyclone, to prevent caking when liquid or viscid materials are processed. Air escaping from the top of the cyclonic unit is captured and conveyed to a dust collection unit. Alternatively, the air may be conveyed to a secondary cyclonic unit equipped with a filtration system and a closed collection chamber.

2. Description of the Related Art

Devices for comminuting and dehydrating are well known. One example is referenced in U.S. Pat. No. 5,236,132 issued to the applicant on Aug. 17, 1993, which patent is incorporated herein by reference. Such prior art comminuting and dehydrating devices comprise a cyclone chamber mounted atop a conical body, an adjustable coaxial sleeve for introducing material to be processed, a damper for reducing air flow through the sleeve, and a blower. A feeder unit is interposed between the blower and the chamber, and material may also be introduced into the chamber through the coaxial sleeve. Processed material may be deposited on a conveyor, pneumatic conveyance system, or collected in an open bin. Such cyclonic comminution devices are suitable for processing materials such as minerals, plants, food products, recyclable materials, and soil.

They may be employed for pulverizing and separating ores such as gold, silver, copper, kaolin and which are recovered from rock formations presenting a different density or structure than the ore. They may also be employed to pulverize and dehydrate materials such as gypsum, fly ash, foundry shag, coal, coke, phosphates and residual products of refining and distillation processes, as well as animal shells and crustaceans as well as bones, diatomaceous earth and soil structures. They may be employed to pulverize, dehydrate, and preserve food products such as grain, and grain components such as gluten and for fractionalization of the starch protein matrix, as well as for enhancement of lipid or fiber content for further processing or defatting. They may be employed for fragmentation and dehydration of fibrous foods such as carrots, apples, beans, and spinach and for pulverization and dehydration of lignocellulosic biomass materials such as trees, seaweed, straw, peat moss, waste paper and animal wastes. Such cyclonic comminuter dehydrator units may also be employed in recycling for pulverizing glass, metals, plastic and organic materials so that such components may be mechanically sorted and separated. The units may also be used to pulverize and dehydrate soil and to separate it from rock, ash, boron, hydrocarbons and other contaminants, either alone or in conjunction with washing, thermal, biological, or other treatment processes.

However, such comminuter dehydrators are not particularly suitable for processing viscid materials or materials including additives such as milk whey, raw eggs or wheat gluten. Moreover, such devices emit small particles of the processed materials into the air as dust. Such emissions not only reduce the efficiency of the process, but may be environmentally undesirable.

SUMMARY OF THE INVENTION

The present invention overcomes the problems previously outlined and provides a greatly improved comminuting and dehydrating system which is efficient, environmentally sound, and which is particularly well adapted for processing liquid or sticky materials.

Broadly speaking, the system includes a cyclone device for comminuting and dehydrating, equipped with a discharge containment unit. A single blower is coupled with the cyclone to provide air flow, and a channel is included between the blower and the containment unit to provide pressure equalization. An injection port is positioned remotely adjacent the discharge portion of the cyclone to permit injection of viscid substances such as eggs directly into the low pressure region of the cone.

In preferred forms, a pair of cyclone devices are intercoupled, each being equipped with a discharge containment unit. In still other preferred forms the secondary cyclone device includes an exhaust filter and a meter for measuring the passage of material to be comminuted and dehydrated.

OBJECTS AND ADVANTAGES OF THE INVENTION

The principal objects and advantages of the present invention include providing a closed-loop system for simultaneously comminuting and dehydrating materials while reducing and controlling dust and other emissions; providing such a system which processes a wide variety of materials with increased efficiency; providing such a system having enlarged capacity; providing such a system which is particularly well-adapted to handling viscid materials; providing such a system which permits injection of liquid and viscid materials and additives into the low pressure zone of the cyclone; Providing such a system that filters intake air; providing such a system that filters exhausted air; providing such a system in which each cyclone is equipped with a closed material collection chamber; providing such a system which, excepting a single blower and a material feeder, has no operably moving parts, providing such a system which can be portable or stationary, depending on the application; providing such a system in which the pressure in the closed material collection chamber may be regulated and equalized; providing such a system in which the material to be processed in the secondary cyclone may be metered; and providing such a system in which materials to be processed may be added to one or both cyclones.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE PREFERRED EMBODIMENTS

Figures 1, 2, 3:
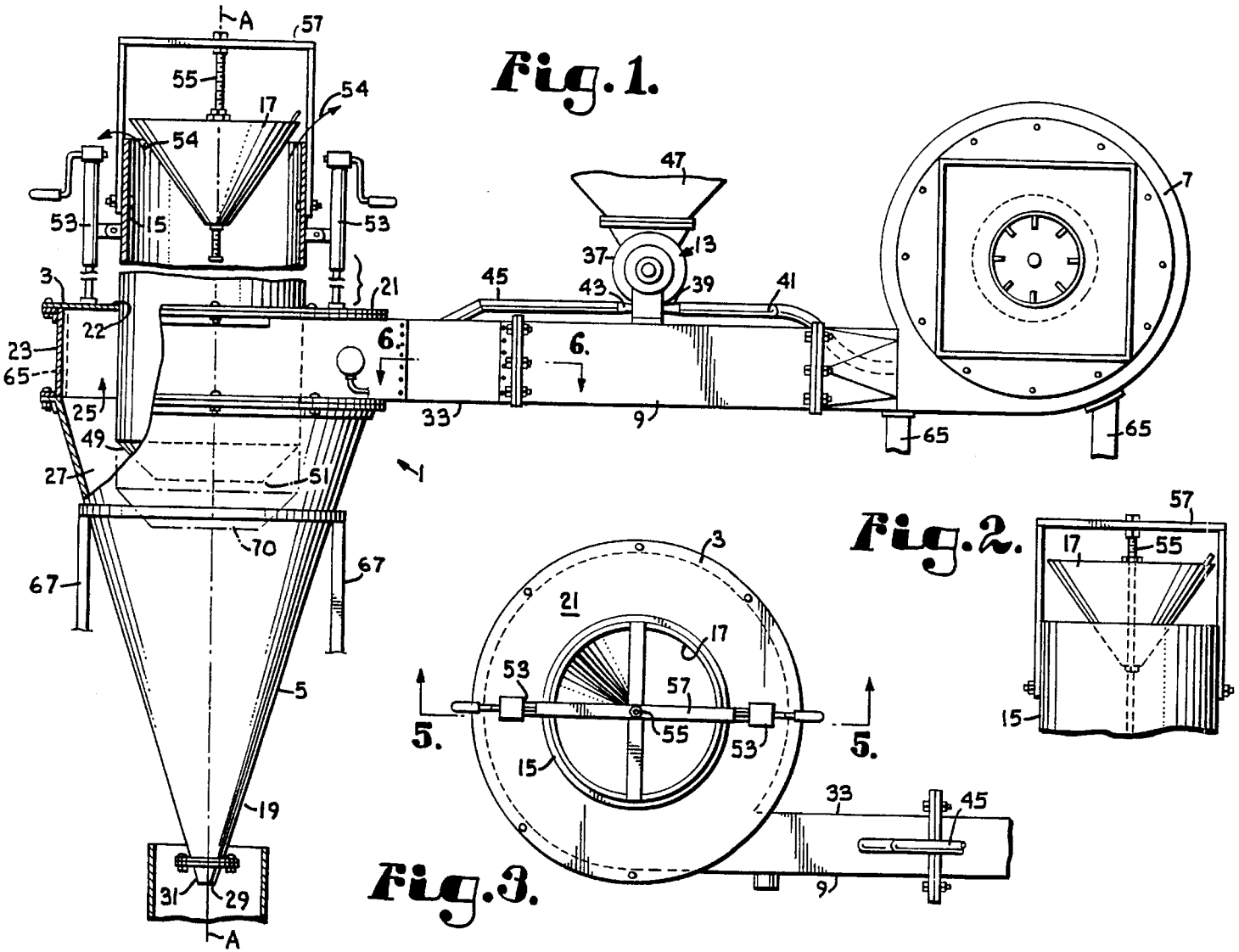
FIG. 1 depicts a fragmentary side elevational view of a gradient-force comminuter/dehydrator apparatus in accordance with the present invention, with parts broken away for clarity and with certain parts shown in phantom.
FIG. 2 is a fragmentary view of the device of FIG. 1, showing a damper thereof.
FIG. 3 is a fragmentary, top plan view of the damper of FIG. 2.
Figure 4:
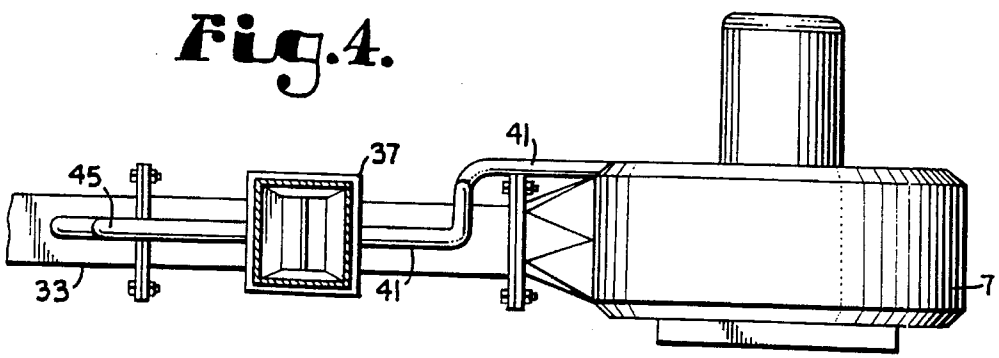
FIG. 4 is a fragmentary, top plan view of a material feeder valve coupled to a blower and manifold of the apparatus.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

I. Comminuter/Dehydrator Apparatus

The reference numeral 1 generally refers to a gradient-force comminuter/dehydrator apparatus for comminuting a variety of different materials having various sizes and various physical characteristics, in accordance with the present invention, as shown in FIGS. 1 through 8. The apparatus 1 comprises a cylindrical chamber 3, a body 5, pressurizing means such as a blower 7 and ducting means 9, air velocity enhancing means such as a venturi mechanism 11, material introducing means 13 for introducing material being comminuted into the apparatus 1, comminuting rate control means and coarseness control means for controlling the rate of comminution of the material being comminuted and the coarseness of the comminuted material such as a sleeve 15 in conjunction with a damper 17, and gravitational discharge means 19 for utilizing gravity to discharge the comminuted material from the apparatus 1.

The cylindrical chamber 3 has a closed, annularly shaped top 21 having a centrally spaced orifice 22, a closed side 23, an open bottom 25, and a generally vertically oriented axis AA, as shown in FIG. 1.

The body 5 has an inverted, conically shaped cavity 27 with base dimensions substantially similar to the inside dimensions of the chamber 3. The body 5 has a truncated lower end 29 and a generally vertically oriented axis which is substantially colinear with the axis of the chamber 3. The body 5 is connected to and suspended generally below the chamber 3. For some applications, the body 5 has one or more detachable nozzles 31, the removal of which provides greater truncation of the conically shaped body 5. Preferably, the conically shaped cavity 27 subtends an angle, as indicated by the arrow designated by the numeral 32 in FIG. 5, within the range of 28° to 42°. More preferably, the cavity 27 subtends an angle of approximately 36°.

The blower 7, such as a Model 602A Pressure Blower as provided by Garden City Fan & Blower Company, provides air at high volume and high velocity. Those skilled in the art will appreciate that blower 7 may be powered by electricity, gasoline, or any other suitable fuel. The ducting means 9 include a manifold 33 for connecting the blower 7 to the chamber 3. In one application of the present invention, the manifold 33 had dimensions of 6½-inches width and 9-inches height. For example, air flow of approximately 1,000–80,000 cfm may be used while maintaining a static pressure of approximately 3–150 inches.

The manifold 33 is connected to the chamber 3 such that air being forced therethrough into the chamber 3 is generally directed substantially tangentially into the chamber 3. To maintain consistency with natural forces, the air is introduced into the chamber 3 on the left side (northern hemisphere) such that the air spirals in a clockwise direction as viewed downwardly.

The venturi mechanism 11 generally includes a pair of opposing, arcuately shaped sidewall plates 34 spaced within the manifold 33 such that a throat 35 is formed therebetween. In one application of the present invention, the throat 35 had a width of approximately 3½ inches. The venturi mechanism 11 is generally spaced in close proximity to the chamber 3.

The material introducing means 13 may include a valve 37, such as a Model VJ8x6 Airlock Valve as provided by Kice Industries, Inc. An input port 39 of the valve 37 is connected to the blower 7 by an upstream pipe 41 such that a portion of the pressurized air being transferred from the blower 7 to the chamber 3 is routed through the valve 37. An output port 43 of the valve 37 is connected to the manifold 33 by a downstream pipe 45 such that material being comminuted and dehydrated by the apparatus 1 is generally directed into the manifold 33 either at, or downstream from, the venturi mechanism 11. A hopper 47 is mounted on the valve 37 such that material being comminuted is gravitationally fed into the valve 37.

The sleeve 15 is generally cylindrically shaped and has an outside diameter dimensioned slightly smaller than the dimensions of the orifice 22. The sleeve 15 extends axially through the chamber 3 and extends into the cavity 27 spaced therebelow. The sleeve 15 includes a truncated, conically shaped flange 49 which has an open lower end 51.

Elevating means, such as a pair of jacks 53 spaced diametrically across the sleeve 15 and generally above the chamber 3, are adapted to cooperatively, axially adjust the sleeve 15 relative to the chamber 3 and the cavity 27.

The damper 17 is adapted to selectively restrict air flowing through the sleeve 7 from the cavity 27 into the ambient atmosphere, as indicated by the arrows designated by the numeral 54 in FIG. 1. The damper 17 is generally threadably mounted on a vertically oriented threaded rod 55 connected to a bracket 57 which is connected to the sleeve 15, as shown in FIGS. 1 and 2, such that the damper 17 is adjustable toward and away from the sleeve 15. Preferably, the damper 17 is configured as an inverted cone. In one application of the present invention, the conically shaped the damper 17 subtended an angle of approximately 70°.

The damper 17 generally has slots 59 near the lower extremity thereof. A gate mechanism 61 is adapted to selectively open and close the slots 59 such that selected material being comminuted can pass therethrough. A discharge tube 63 is detachably connected to the damper 17 such that material falling through the slots 59 is gravitationally introduced directly into the cavity 27 as hereinafter described.

In one application of the present invention, the apparatus 1 includes turbulence-enhancing means comprising a plurality of ribs 65. Each of the ribs 65 is generally elongate, having a length approximately equal to the axial length of the chamber 3 and has a roughened surface. The ribs 65 are spaced apart in parallel fashion along the inner perimeter of the chamber 3. Frame means 67 are provided as needed to maintain the various portions of the apparatus 1 in their relative positions and for mounting on a trailer (not shown) for portability, if desired.

In an application of the present invention, the blower 7 is activated such that high volume, high velocity air is introduced substantially tangentially into the chamber 3 whereby that air is further pressurized, cyclonically, in the chamber 3 and in the cavity 27. Due to the centrifugal forces present in the cyclonic environment, the pressure nearer the outer extremities of the cavity 27 is substantially greater than atmospheric pressure, while the pressure nearer the axis of the cavity 27 is less than atmospheric pressure.

Figure 5:
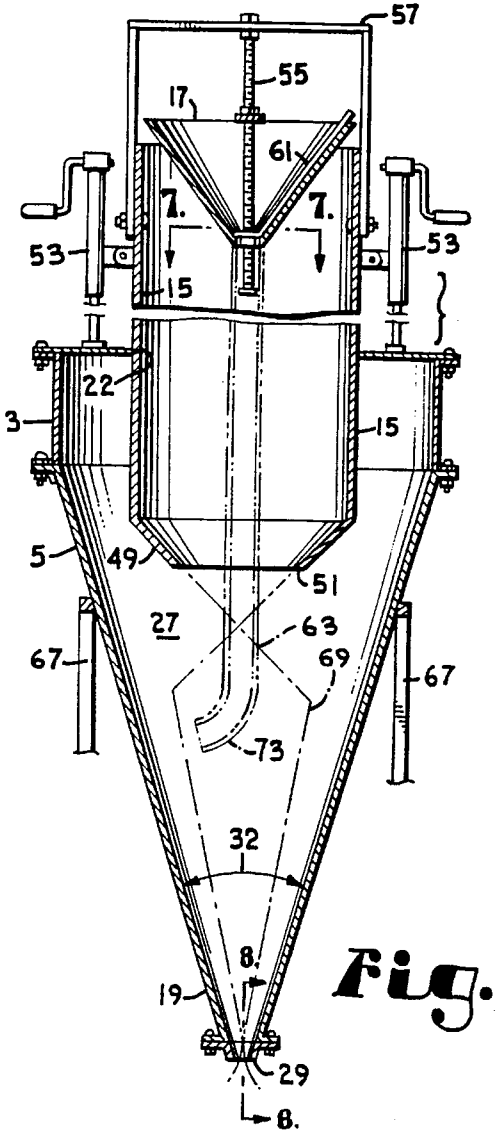
FIG. 5 is an enlarged sectional view taken generally along line 5—5 of FIG. 3.

A profile line, designated by the dashed line designated by the numeral 69 in FIG. 5, indicates the approximate boundary between the region of the cavity 27 having pressures above atmospheric pressure from the region of the cavity 27 having pressures below atmospheric pressure. The pressure-gradient and coriolis forces across and the collision interaction between particles contained in the high-velocity cyclonically pressurized air are violently disruptive to the physical structure of those particles, thereby comminuting and generally dehydrating them.

As the sleeve 15 is lowered by adjusting the jacks 53, as indicated by the phantom lines designated by the numeral 70 in FIG. 1, the profile line 69 moves radially outwardly, providing greater cyclonic velocities and force gradients. Thus, vertical adjustment of the sleeve 15 allows the apparatus 1 to be adapted to accommodate materials having widely different physical characteristics.

The lower the sleeve 15 is spaced relative to the cavity 27, the higher the material being comminuted tends to be distributed in the cyclonic environment of the cavity 27. Also, the lower the relative spacing of the sleeve 15, the greater the cyclonic action within the cavity 27 and, possibly, the greater the suction near the vortex or center of the open lower end 29, as indicated by the arrow designated by the numeral 71 in FIG. 8, causing generally vertical, cochleating and resonating, oscillatory patterns in the air flow containing the material being comminuted to be more violent and thereby affecting the coarseness of the comminuted material. For some applications and configurations of the apparatus 1, the air flow indicated by the numeral 71 may only be nominal.

Similarly, adjusting the damper 17 relative to the sleeve 15, which controls the volume of air allowed to escape from the center, low-pressure region of the cavity 27 into the ambient atmosphere, affects the cyclonic velocities, force gradients, and vertical oscillations as the apparatus 1 is adjusted to handle various throughput volumes of materials being comminuted.

The throughput rate for comminuting the material is controlled by adjusting the rate and manner in which material is being fed into the apparatus 1. If the material is to be both comminuted and dehydrated, then the material is generally fed into the apparatus 1 by the valve 37. In that event, the gate mechanism 61 may be used as a fine control for the coarser adjustments of the damper 17 relative to the sleeve 15.

If the material is relatively fine, such as wheat and the like, and is to be largely comminuted and only minimally dehydrated, then the material may be fed into the apparatus 1 by the damper 17 and the gate mechanism 61 in cooperation with the slots 59. In that event, the material being comminuted falls through the slots 59 and drops gravitationally downwardly through the discharge tube 63 where an elbow 73 injects the material directly into the high cyclonic pressure region of the cavity 27.

Figure 8:
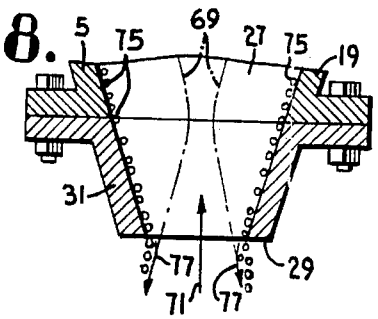
FIG. 8 is an enlarged, fragmentary, partially schematic, sectional view of a nozzle of the device of FIG. 1 taken along line 8—8.
Figure 7:
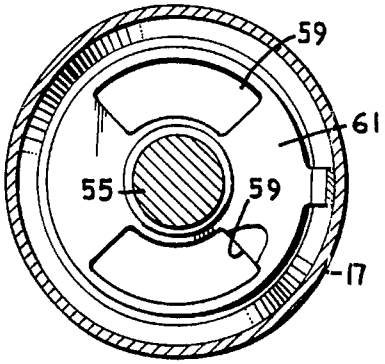
FIG. 7 is an enlarged fragmentary, top plan view of a gate mechanism of the device with parts broken away for clarity, taken along line 7—7 of FIG. 5.
Figure 6:
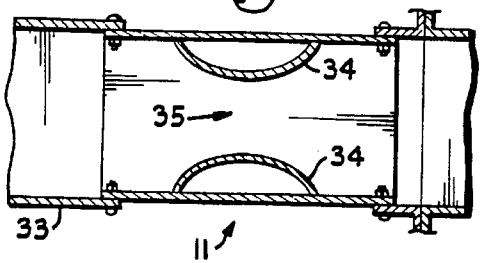
FIG. 6 is an enlarged sectional view taken along line 6—6 of FIG. 1 showing a venturi mechanism thereof.

As the material is comminuted, the finer particles thereof tend to diffuse to the conical perimeter of the cavity 27, as indicated by the numeral 75 in FIG. 8. As those finer particles accumulate, they tend to move gravitationally downwardly to the open lower end 29 where the particles exit from the apparatus 1, assisted by the annularly shaped air leakage from the cyclonically higher pressure region along the perimeter of the cavity 27, as indicated by the arrows designated by the numeral 77 in FIG. 8. By continually feeding material into the apparatus 1, a continuous throughput of comminuted material is provided.

By selectively utilizing the apparatus 1 with and without the nozzle 31, a greater range of sizes and types of materials, and greater throughput rates are obtainable with the apparatus 1.

A container, conveyor belt or other suitable arrangement (not shown) spaced below the lower end 29 receives the comminuted material as it is gravitationally discharged from the apparatus 1.

II. Closed-loop Comminuting and Dehydrating system

Figure 9:
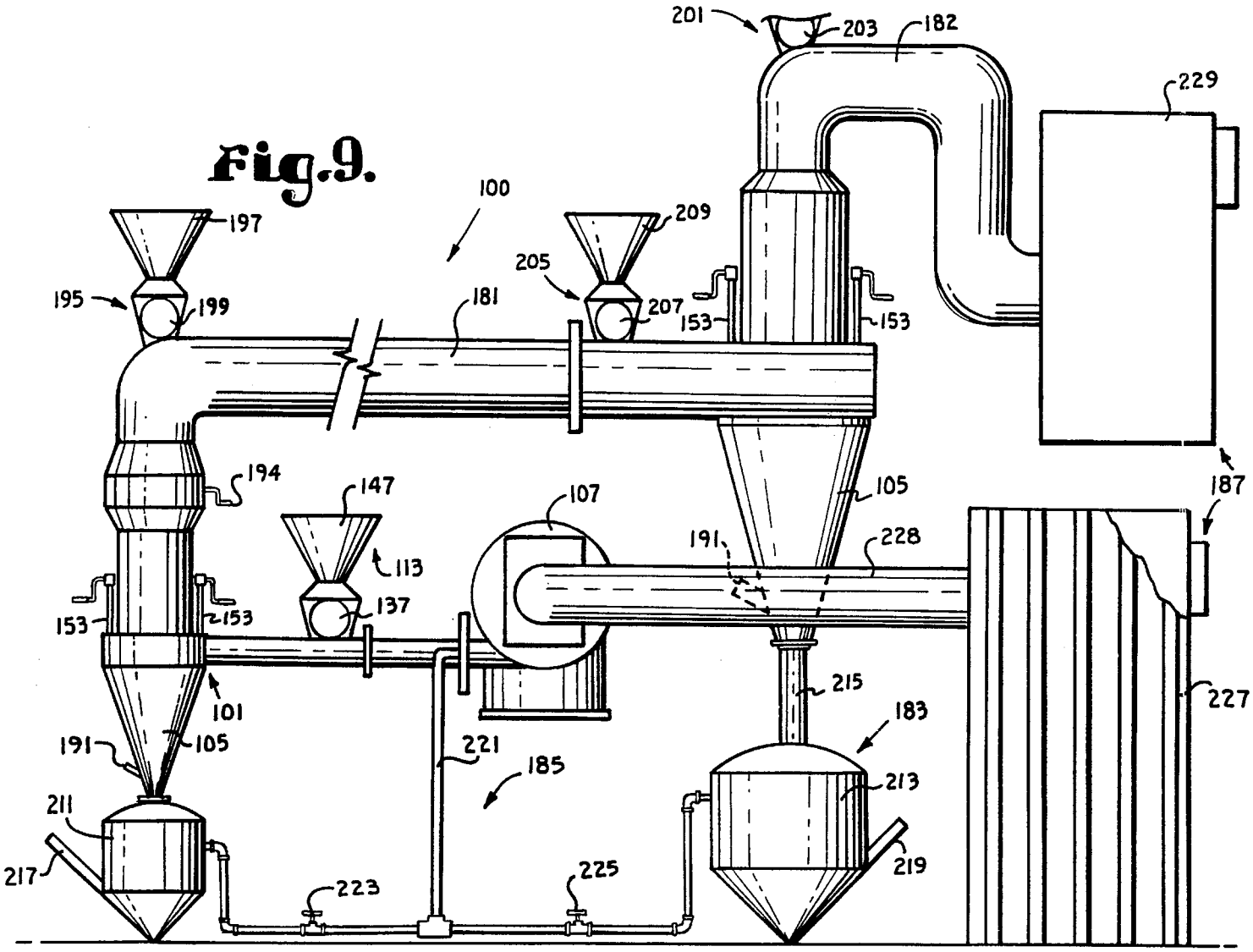
FIG. 9 is a side elevational view of an alternate embodiment of a closed loop gradient force comminuting and dehydrating system in accordance with the present invention, with material introduction apparatus shown schematically.
Figure 10:
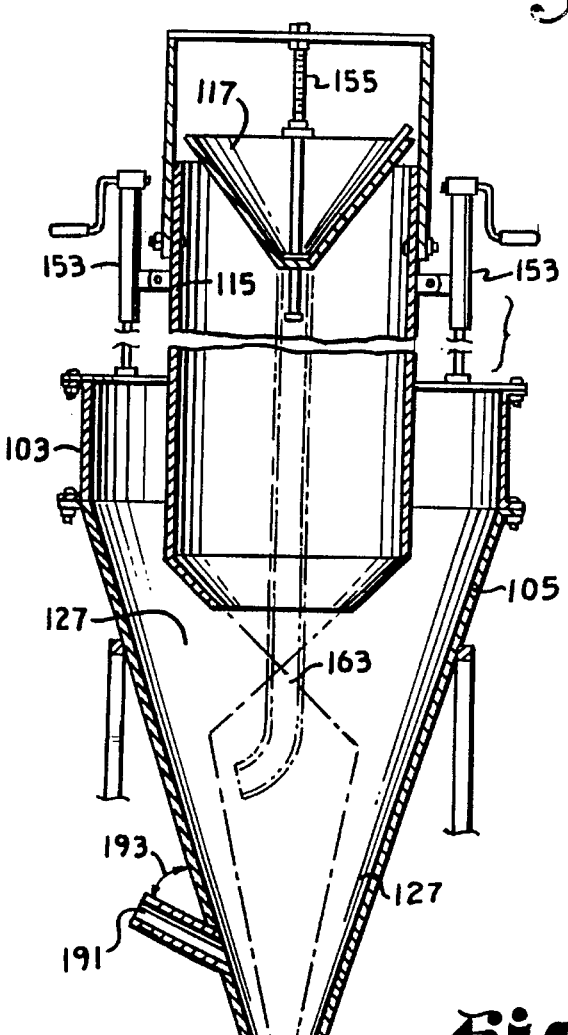
FIG. 10 is an enlarged, fragmentary, sectional view taken generally along line 10—10 of FIG. 9.
Figure 11:
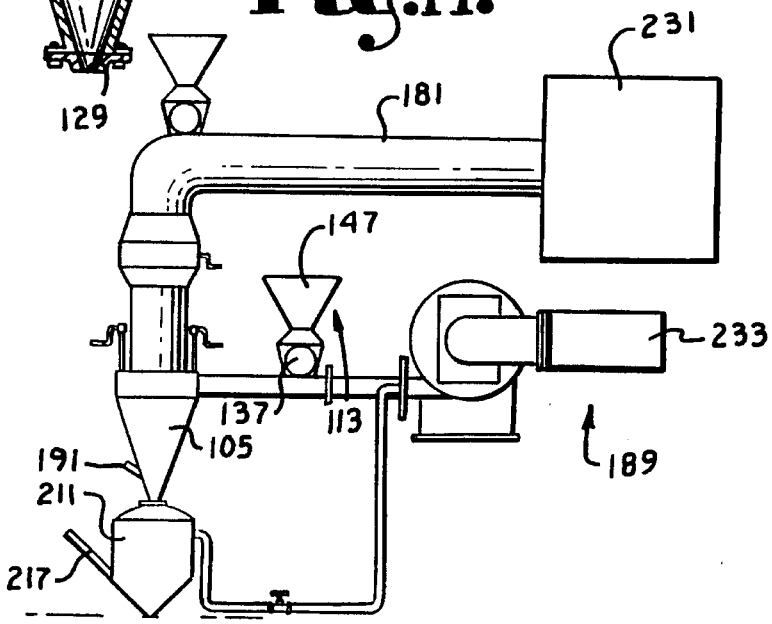
FIG. 11 is a side elevational view of an alternate embodiment of a closed loop gradient force comminuting and dehydrating system in accordance with the present invention.

Referring now to FIGS. 9, 10, and 11, a closed-loop comminuting and dehydrating system 100 includes a primary comminuter/dehydrator apparatus 101 which is substantially similar to the comminuter/dehydrator previously described. The numbering and description of all common elements will not be reiterated. Those elements which are described will be numbered as set forth in FIGS. 1–8 with the addition of 100.

The system 100 also includes a secondary comminuter/dehydrator apparatus 179, a conduit 181 remotely intercoupling the primary and secondary units, a containment system 183, pressure equalization structure 18S, filtration system 187, and noise reduction mechanism 189.

Both primary and secondary comminuter/dehydrator units 101, 179 include a material introduction port 191 positioned on the lower portion of the body 105, generally adjacent the low pressure zone of the cyclone. As best shown in FIG. 10, port 191 and body 105 subtend an acute angle 193, so that liquid or viscid materials may be cooperatively introduced by gravity and vacuum directly into the low pressure zone where the product is immediately surrounded by an air envelope and drawn upwardly into the chamber 103. In this manner, the caking problems previously associated with processing liquid and viscid materials are eliminated.

In certain preferred embodiments an extruder apparatus may be coupled with port 191 for metering such liquid or viscid material. The interior surfaces of body 105 may be coated with a "no-stick" material such as a fluorocarbon polymer to further inhibit adhesion of materials to the inner surfaces of the body.

A jack 194 is coupled with damper rod 155 to permit remote adjustment of damper 117. Jack 194 may be operated manually or a hydraulic cylinder or electric screw may be employed. In certain preferred embodiments, both sleeve jacks 153 and system 100 may be provided with one or more pressure sensing devices in the chambers 103 to permit computerized control.

A conduit 181 intercouples primary and secondary comminuter/dehydrator units 101, 179. Conduit 181 fits over sleeve 115 and damper 117 of the primary comminuter/dehydrator unit in sealing relationship and extends in generally horizontal orientation for lateral coupling with chamber 103 of secondary unit 179. Airflow through conduit 181 and into chamber 103 is substantially tangential as previously described with respect to primary unit 101. A similar conduit 182 intercouples secondary comminuter/dehydrator unit 179 with filtering apparatus 187.

Conduit 181 forms an elbow in the region generally above comminuter/dehydrator 101 whereon is coupled a material introduction device 195, depicted schematically in FIG. 9. Device 195 includes a hopper 197 to permit gravitational feeding of material through sleeve 115 and into chamber 103. The device may also be equipped with an airlock valve 199. Similarly, conduit 182 forms an elbow above comminuter/dehydrator 179 whereon is coupled a material introduction device 201, having a hopper (not shown), and which may also be equipped with an airlock valve 203. Generally adjacent secondary comminuter/dehydrator 179, conduit 181 is coupled with a material introduction device 205, equipped with an airlock 207 and hopper 209.

Conduit 181, 182 may be constructed of sheet metal or stainless steel tubing where food materials are to be processed. In especially preferred embodiments the conduit is constructed of ribbed flexible tubing to permit easy assembly and disassembly of the system for portability.

The airlock 207 may be operated electrically or by a hydraulic system where the blower 107 is run on fossil fuel.

Containment system 183 includes a pair of generally cylindroconical collection units 211, 213. Primary unit 211 is coupled in sealing relationship with comminuter/dehydrator unit lower end 129. A conduit 215 is employed to intercouple elevated secondary unit 179 with collection unit 213. The conical apex of each unit may be equipped with an airlock device (not shown) to permit additional processing of the comminuted and dehydrated material. Collection units 211, 213 are equipped with material removal ports 217, 219, each of which may be coupled with an auger or vacuum device (not shown) for removal of processed material.

Pressure equalization system 185 includes a conduit 221 and a pair of control valves 223, 225. One end of conduit 221 is coupled with the intake side of blower unit 107 and the other end bifurcates for intercoupling with the upper portion of each collection unit 211, 213.

Filtration system 187 includes a pair of filters 227, 229. Air is drawn through filter 227, into conduit 228, into blower 107 and eventually passes through secondary comminuter/dehydrator unit 179 and out to the atmosphere through filter 229. Filters 227, 229 may be constructed of fibers, charcoal, or any other suitable material. They may be electrostatic for soil remediation uses, or adapted for ozone or other gaseous removal. Where the system is employed for processing foodstuffs such as wheat and the like, the filter material should be capable of removing mold spores. In preferred embodiments each filter 227, 229 comprises a room or "bag house".

The intake portion of blower 107 is coupled with a noise reduction mechanism 189, depicted in FIG. 11 to comprise an attenuator 233. Attenuator 233 mutes the noise produced by high velocity airflow through blower intake. Alternatively as shown in FIG. 9, where a filter room 227 is employed to purify the intake flow of air, the noise is muffled so that an attenuator may not be required. In still other preferred embodiments, both attenuator 233 and filter room 227 may be employed.

Those skilled in the art will appreciate that the closed loop system 100 described herein may comprise more than two comminuter/dehydrator units coupled in series, with airflow produced by a single blower unit. In certain preferred embodiments a single comminuter/dehydrator unit is employed. In such embodiments the output end of conduit 181 may be coupled with a filter room or dust collector or other equipment for further processing of the material as shown schematically at 231. For portability, the system 100 may be mounted on a frame having ground engaging wheels. In such applications conduits 181, 182, 228 may be uncoupled for transport.

In use, high velocity air is drawn through a filter room 227 and introduced into the closed loop system 100 by a single blower 107 in the manner previously described. Airflow in the cyclones 101, 179 is regulated by adjustment of sleeve and damper jacks 153, 194 to produce a force gradient adapted to comminute and dehydrate the material to be processed.

Material may be fed into primary cyclone 101 by the hopper 147, through airlock valve 137, and into conduit 109. The material is carried into the cyclone 101 by the high velocity air generated by blower 107. Additional material may be introduced into cyclone 101 by hopper 197, through airlock 199 and into conduit 181. The material falls by gravity through damper 117 and discharge tube 163 into the high cyclonic pressure region of cavity 127. Liquid or viscous materials such as milk whey, eggs, and wheat gluten, materials which have been previously subjected to washing such as mineral slurries, and liquid or viscid additive compositions may be introduced through port 191 directly into the low pressure region of the cyclone, where they are immediately enveloped by dehydrating high velocity air. In this manner material may be dehydrated before coming into contact with the sides of cavity 127, and caking is minimized.

Finer comminuted material settles by gravity into collection unit 211. Adjustment of control valve 223 equalizes the pressure in collection unit 211 so that the processed material may settle easily. The material is removed through port 211 to permit continuous throughput.

Depending on the adjustment of sleeve and damper jacks 153, 194, the pressurized air carries material of a predetermined particle size upwardly though sleeve 115, past damper 117 and into conduit 181. The material is borne along conduit 181 by the high velocity air generated by blower 107 and into secondary comminuter unit 179 for further comminution and dehydration. Material may be fed into secondary cyclone 179 by material introduction devices 201, 205 substantially as previously described. The material falls by gravity through damper 117 and discharge tube 163 into the high cyclonic pressure region of cavity 127. Liquid or viscid materials may also be introduced into secondary comminuter 179 through port 191.

Comminuted material settles by gravity into collection unit 213, which is pressure equalized by adjusting control valve 225. Processed material is removed through port 219 to permit continuous throughput.

Pressurized air containing particles too fine to settle into collection unit 213, passes upwardly from unit 179 and into conduit 182, through a filter room 227, and into the atmosphere.

In other preferred embodiments shown schematically in FIG. 11, the material passes into a dust collector for material classification.

In this manner, the closed loop system 100 employs the spent air from a primary cyclone to drive a secondary cyclone or dust collector unit in an energy efficient process which is environmentally protective and adapted for a wide range of materials including liquid or viscid materials previously unsuitable for cyclonic processing.

It is to be understood that while certain forms of the present invention have been illustrated and described herein, it is not to be limited to the specific forms or arrangement of parts described and shown.

What is claimed and desired to be secured by Letters Patent is as follows:

1. A closed-loop system for comminuting and dehydrating material, comprising:

(a) a cyclone apparatus having a cylindrical chamber presenting a diameter and a generally vertically oriented axis, a body having an inverted, conically shaped cavity presenting a generally vertically oriented axis and having an open truncated lower end; said body being coupled with said chamber in suspended relationship; said cavity having a base coupled with said chamber, said base presenting a diameter substantially equal to the diameter of said chamber, first material introducing means for introducing material to be comminuted and dehydrated into said apparatus, second material introducing means for introducing material to be comminuted and dehydrated into said apparatus including first controlling means comprising a cylindrically shaped sleeve axially extending through said chamber and partially through said cavity and second controlling means comprising dampening means located at least partially within said sleeve for dampening air flowing through said sleeve, gravitational discharge means for gravitationally discharging the comminuted material from said apparatus;

(b) wherein said cyclone apparatus includes a third material introduction means comprising a material injection port coupled with the lowermost portion of said conically shaped cavity for permitting addition of material to be comminuted and dehydrated;

(c) containment means coupled with said gravitational discharge means for containing the comminuted material;

(d) air flow means coupled with said cyclone apparatus for causing air to flow through said apparatus; and (e) pressure equalization means intercoupling said containment means and said air flow means.

2. The apparatus as set forth in claim 1 wherein said cyclone chamber is coupled with a filter by a conduit for permitting passage of air upwardly from said cyclone chamber, through said filter and outwardly into the atmosphere.

3. The apparatus as set forth in claim 1 wherein said cyclone chamber is coupled with a dust collector by a conduit for permitting passage of air upwardly from said cyclone chamber, through said dust collector and outwardly into the atmosphere.

4. A closed-loop system for comminuting and dehydrating material, comprising:

(a) first and second cyclone apparatus, each having:

(1) a cylindrical chamber presenting a diameter and a generally vertically oriented axis;

(2) a body having an inverted, conically shaped cavity presenting a generally vertically oriented axis and having an open truncated lower end; said body being coupled with said chamber in suspended relationship; said cavity having a base coupled with said chamber, said base presenting a diameter substantially equal to the diameter of said chamber;

(3) first material introducing means for introducing material to be comminuted and dehydrated into said apparatus;

(4) second material introducing means for introducing material to be comminuted and dehydrated into said apparatus including first controlling means comprising a cylindrically shaped sleeve axially extending through said chamber and partially through said cavity and second controlling means comprising dampening means located at least partially within said sleeve for dampening air flowing through said sleeve;

(5) gravitational discharge means for gravitationally discharging the comminuted material from said apparatus;

(6) containment means coupled with said gravitational discharge means for containing the comminuted material;wherein said first cyclone chamber and said second cyclone chamber are intercoupled by conduit means for permitting passage of comminuted material upwardly from said first cyclone chamber to said second cyclone apparatus;

(b) air flow means coupled with said first cyclone apparatus for causing air to flow through said first apparatus, upwardly through said conduit means, and into said second apparatus; and (c) pressure equalization means intercoupling said first containment means and said air flow means.

5. The system as set forth in claim 4 wherein said first cyclone apparatus further includes a third material introduction means comprising a material injection port coupled with the lowermost portion of said conically shaped cavity for permitting addition of material to be comminuted and dehydrated.

6. The system as set forth in claim 5 wherein said second cyclone apparatus further includes a third material introduction means comprising a material injection port coupled with the lowermost portion of said conically shaped cavity for permitting addition of material to be comminuted and dehydrated.

7. The system as set forth in claim 4 wherein said pressure equalization means further includes control means for controlling the passage of air between said air flow means and said first containment means.

8. The system as set forth in claim 4 wherein said cavities each further include an interior surface having a synthetic resinous coating for preventing adhesion of comminuted materials.

9. The system as set forth in claim 4 wherein said first material introducing means each further includes metering means for metering the passage of said material to be comminuted and dehydrated.

10. The system as set forth in claim 4 wherein the uppermost portion of the cylindrical chamber in said second cyclone apparatus further includes filter means for filtering exhausted air flow.

11. The system as set forth in claim 4 wherein said containment means each further include means for conveying said comminuted and dehydrated material away from said system for storage.

12. In combination with a first apparatus for comminuting and dehydrating material, said first apparatus having a cylindrical chamber presenting a diameter and a generally vertically oriented axis; a body having an inverted, conically shaped cavity presenting a generally vertically oriented axis and having an open truncated lower end, said body being coupled with said chamber in suspended relationship, said cavity having a base coupled with said chamber, said base presenting a diameter substantially equal to the diameter of said chamber; first material introduction means for introducing material to be comminuted and dehydrated into said apparatus; second material introducing means for introducing material to be comminuted and dehydrated into said apparatus including first controlling means including a cylindrically shaped sleeve axially extending through said chamber and partially through said cavity and second controlling means including dampening means located at least partially within said sleeve for dampening air flowing through said sleeve; and gravitational discharge means for gravitationally discharging the comminuted material from said apparatus, the improvement comprising:

(a) a second apparatus for comminuting and dehydrating material;

(b) conduit means intercoupling said first cylindrical chamber with said apparatus for permitting passage of comminuted material upwardly from said first cylindrical chamber to said second apparatus;

(c) air flow means coupled with said first cyclone apparatus for causing air to flow through said first apparatus, upwardly through said conduit means, and into said second apparatus;

(d) first containment means coupled with said gravitational discharge means for containing said comminuted material; and (e) pressure equalization means intercoupling said first containment means and said air flow means.

13. The improvement as set forth in claim 12 and further comprising third material injection means including a port coupled with the lowermost portion of said conically shaped cavity of said first apparatus for permitting addition of material to be comminuted and dehydrated.

14. A closed-loop system for comminuting and dehydrating material, comprising:

(a) first and second gradient-force cyclone members for comminuting and dehydrating material;

(b) conduit means intercoupling said first cyclone member and said second cyclone for permitting passage of comminuted material from said first cyclone member to said second cyclone member;

(c) air flow means coupled with said first cyclone for causing air to flow through said first cyclone member, upwardly through said conduit means, and into said second cyclone;

(d) first and second containment means respectively coupled with said first and second cyclone members for containing comminuted and dehydrated material; and (e) pressure equalization means intercoupling said first containment means and said air flow means.

15. The system as set forth in claim 14 wherein said first cyclone member further includes material injection means coupled with a lowermost portion thereof for permitting addition of material to be comminuted and dehydrated.

16. A method for comminuting an dehydrating material, comprising the steps of:

(a) providing an apparatus having:

(1) a cylindrical chamber having a diameter and a generally vertically oriented axis;

(2) a body having an inverted, conically shaped cavity presenting a generally vertically oriented axis and having an open truncated lower end; said body being coupled with said chamber in suspended relationship; said cavity having a base coupled with said chamber, said base presenting a diameter substantially equal to the diameter of said chamber;

(3) first material introducing means for introducing material to be comminuted and dehydrated into said apparatus;

(4) second material introducing means for introducing material to be comminuted and dehydrated into said apparatus, including:

(A) first controlling means for controlling the rate of comminuting the material, said first controlling means including a cylindrically shaped sleeve axially extending through said chamber and partially through said cavity; and (B) second controlling means comprising dampening means located at least partially within said sleeve;

(5) third material introduction means comprising a material injection port coupled with the lowermost portion of said conically shaped cavity;

(6) containment means coupled with said gravitational discharge means for containing the comminuted material;

(7) air flow means coupled with said cyclone apparatus for causing air to flow through said apparatus;

(8) pressure equalization means intercoupling said containment means and said air flow means;

(b) causing air from said air flow means to cyclonically flow through said chamber and said cavity;

(c) introducing material into said apparatus and comminuting and dehydrating said material;

(d) adjusting said first and second controlling means to select the desired rate of comminuting the material and to select the desired coarseness of the comminuted material, respectively; and (e) gravitationally discharging comminuted material from said apparatus into said containment means.

* * * * *